US005536367A

United States Patent [19]

Salminen

[11] Patent Number: 5,536,367

[45] Date of Patent: Jul. 16, 1996

[54] PULP DIGESTER CLEANING SYSTEM

[76] Inventor: Reijo K. Salminen, 373 Cove Rd., Bellingham, Wash. 98226

[21] Appl. No.: 377,647

[22] Filed: Jan. 25, 1995

[51] Int. Cl.[6] ..... D21C 3/22; D21C 7/08; D21C 7/12; D21C 7/14

[52] U.S. Cl. ..... 162/48; 162/17; 162/52; 162/55; 162/251; 162/243; 162/248; 210/388; 210/456

[58] Field of Search ..... 162/251, 246, 162/243, 237, 248, 249, 17, 41, 48, 52, 55, 57, 59, 199; 210/384, 388, 456

[56] References Cited

U.S. PATENT DOCUMENTS

| | | | |
|---|---|---|---|
| 2,163,437 | 2/1936 | Richmond | 162/251 |
| 2,667,975 | 2/1954 | Seaholm | 210/388 |
| 2,682,205 | 6/1954 | Vincent | 209/273 |
| 2,852,369 | 9/1958 | Eyolfson | 162/251 |
| 3,711,367 | 1/1973 | Christenson | 162/251 |
| 3,752,319 | 8/1973 | Richter | 210/357 |
| 3,755,072 | 8/1973 | Ostberg et al. | 162/251 |
| 4,547,264 | 10/1985 | Sherman et al. | 162/37 |
| 4,637,878 | 1/1987 | Richter et al. | 210/388 |
| 5,069,752 | 12/1991 | Richter | 162/37 |
| 5,236,554 | 8/1993 | Greenwood | 162/238 |
| 5,271,672 | 12/1993 | Reck | 366/169 |

FOREIGN PATENT DOCUMENTS

| | | | |
|---|---|---|---|
| 90/12147 | 10/1990 | WIPO | D21D 5/16 |

*Primary Examiner*—David L. Lacey
*Assistant Examiner*—Jose A. Fortuna
*Attorney, Agent, or Firm*—Hughes, Multer & Schacht

[57] ABSTRACT

A pulp digester having a number of screening/cleaning units mounted within the digester. Each unit has a screen member and a cleaning propeller which is mounted adjacent the inner surface of the screen member. There is for each unit a hydraulic motor which is positioned entirely within the digester housing, and which rotates the propeller. Hydraulic lines extends through sealed openings in the digester wall and power is supplied from an exterior hydraulic pump which is controlled by a valve.

13 Claims, 6 Drawing Sheets

PULP DIGESTER CLEANING SYSTEM

The present invention relates generally to the art of wood pulp digesters, and more particularly to a method and apparatus for maintaining the screens in the recirculating system of the pulp digester free from clogging with wood chips or other material.

BACKGROUND ART

In a typical continuous pulp digester, the wood chips and the white liquor are fed into the upper end of the digester, with the interior of the digester being maintained at a relatively high pressure (e.g. 200 PSI) and high temperature (e.g. approximately 380° F). The mixture of chips and white liquor moves slowly and downwardly through the digester so that the total dwell time within the digester is generally between about two to four hours. During the period that the wood chips are in the digester, the white liquor reacts with the material in the wood chips to break down certain organic compounds in the wood chips so as to "delignify" the pulp.

At several locations along the length of the digester, portions of the liquid are extracted, either to be recirculated back into the digester, sent to an evaporator, or possibly to be processed elsewhere in the system. To retain the wood chips that are being processed in the digester, the liquid is extracted through sets of screens which are generally placed in sets at vertical locations circumferentially around the digester.

One of the problems in the operation of a digester is that the screens sometimes become clogged, possibly with wood chips and other material. Thus, it becomes necessary from time to time to clean the screens and remove the wood chips or other material which may have become lodged therein.

One prior art method of alleviating this problem to some extent has been to construct the screen with a circular flat surface and to place a rotating blade adjacent to the intake surface of the screen. The blade is rotated to create at the blade surface near the screen a suction, which dislodges wood chips which may be lodged in the openings in the screen. This is accomplished by mounting the screen in a circumferential ring formed in the wall of the digester in a form of a large diameter (e.g. 4 ft) nozzle, with the screen and the blade being mounted within this ring. Then a plate is mounted within the ring to close the ring opening to maintain the pressure and temperature conditions within the digester. There is positioned externally of the digester an electric motor which is used to drive the rotating blade. The shaft of the motor extends through the plate to connect the blade at the location inside of the digester. A rotating seal is maintained around the drive shaft of the electric motor at the location where it passes through the plate.

To the best knowledge of the applicant, while this cleaning apparatus has been used to some extent commercially, such commercial use has been rather limited, due to certain operating problems and other reasons. For example, there are difficulties in maintaining a seal where the shaft of the electric motor extends through the plate within the mounting ring, and leaks will sometimes develop. Another difficulty is the reinforcing of the main pressure vessel around these large diameter nozzles.

SUMMARY OF THE INVENTION

The method and apparatus of the present invention enables the cooking liquid of a pulp digester to be recirculated in the digester, while maintaining the screens of the digester substantially free of material clogging and/or accumulating on the surface of the screens.

The pulp digester apparatus of the present invention comprises a digester containing structure comprising a containing wall defining a digester chamber to contain wood chips and digesting liquid under heat and pressure.

There is at least one discharge screening/cleaning assembly (and desirably a plurality of said assemblies) positioned within the chamber. The assembly comprises:

i. a screen means having an intake surface facing the main section of the chamber and an outlet surface area facing into a liquid receiving region within the containing wall of the structure. The screen means is arranged to permit the liquid to pass therethrough into the receiving region, while preventing the wood chips and fibers from passing therethrough;

ii. liquid outlet means positioned to remove the liquid from the liquid receiving region;

iii. a propeller positioned adjacent to the intake surface of the screen means. The propeller is mounted to move across the intake surface in a manner to cause removal of material from the screen means;

iv. a power means located outside of the containing structure and having a power connection from the power means extending from outside the containing structure into the containing structure;

v. a motor operably connected to the power connection. The motor has a drive output connected to the propeller to cause the propeller to remove the material collecting at the screen means. The motor and the drive connection are positioned entirely within the containing structure.

In the preferred form, the motor is a hydraulic motor, and the power means is a hydraulic pump. The power connection is hydraulic line means extending through the containing structure. The hydraulic line means extends through at least one opening in the containing wall which is sealed to provide a fluid tight connection between the hydraulic line means and the containing wall. In the preferred form, the propeller is mounted for rotation about an axis of rotation, and the drive connection of the hydraulic motor comprises a shaft means connected to the propeller. A specific means of mounting the hydraulic motor is to position it in the liquid receiving region with the shaft means extending through the screen means to connect to the propeller.

In one version, the screen means comprises a support plate which is positioned adjacent to the liquid receiving region and has relatively large openings. There is also an inside screen member positioned adjacent to the main section of the chamber. The inner screen member has opening means of a smaller dimension. In this first version, the inner screen member comprises an elongate strip means defining a relatively narrow elongate opening means. A preferred form is that the elongate strip means comprises a strip arranged in a continuous spiral and defining spiral-like opening means.

In a modified version of the screen means, there is a base plate with relatively large openings. There is an inner plate having reactively small openings spaced inwardly from the base plate to provide a flow area between the base plate and inner plate. A preferred means of spacing the inner plate from the base plate is to form a plurality of outwardly extending dimples in the inner plate to engage the base plate.

In the method of the present invention, the apparatus is provided as described above. The fluid is withdrawn from the collecting region so as to cause fluid to flow from the main chamber through the screen means into the collecting region. At the same time, the propeller is rotated by the motor which is in turn driven by the power means to cause the propeller to move over the inner surface of the screen means for removal of material and fibers.

Other features will become apparent from the following detailed descriptions.

DESCRIPTION OF THE PREFERRED EMBODIMENT

Figure 1:
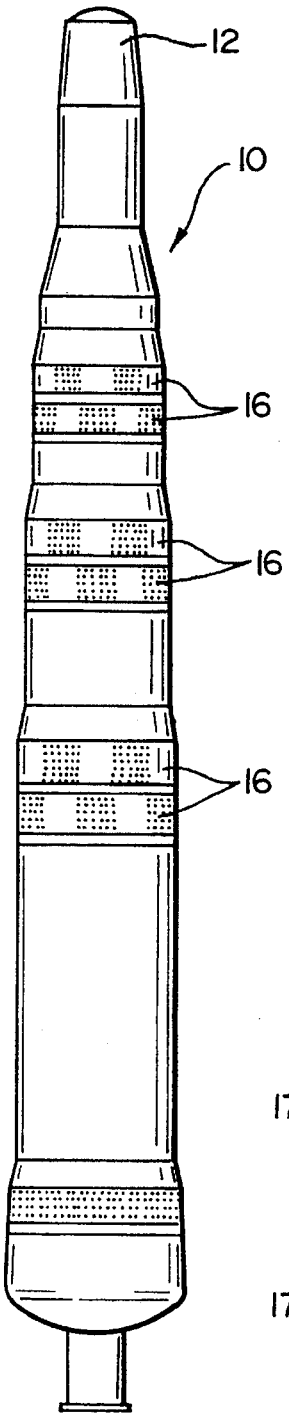
FIG. 1 PRIOR ART
FIG. 1 is a side elevational view of a prior art digester for which the present invention would be adapted.

In FIG. 1 there is shown a typical prior art digester 10 which can readily be adapted for use of the present invention. The digester 10 has the overall configuration of a large tower which is a pressurized container, having a circular cross-sectional configuration, with the longitudinal center axis of the digester 10 being vertically aligned. The digester is made in several sections, with the lowermost section having a larger diameter, and the other sections decreasing in diameter in an upward direction.

In the upper part of the digester there is what is commonly referred to as the "impregnation zone" where the wood chips become impregnated with the white liquor. Below the impregnation zone is a heating zone where the liquid (i.e. liquor) is recirculated through a heat exchanger and back into the digester to maintain the temperature at an adequately high level in this particular digester, there are second and third cooking zones where delignification occurs. At the lowermost part of the digester there is a hot washing zone.

Figure 2:
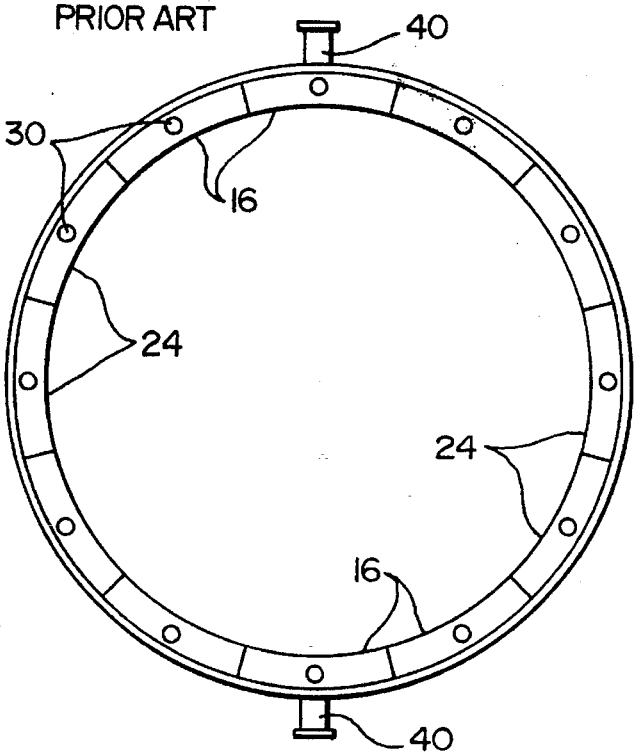
FIG. 2 PRIOR ART
FIG. 2 is a sectional view taken across the vertical longitudinally axis of the digester.
Figure 3:
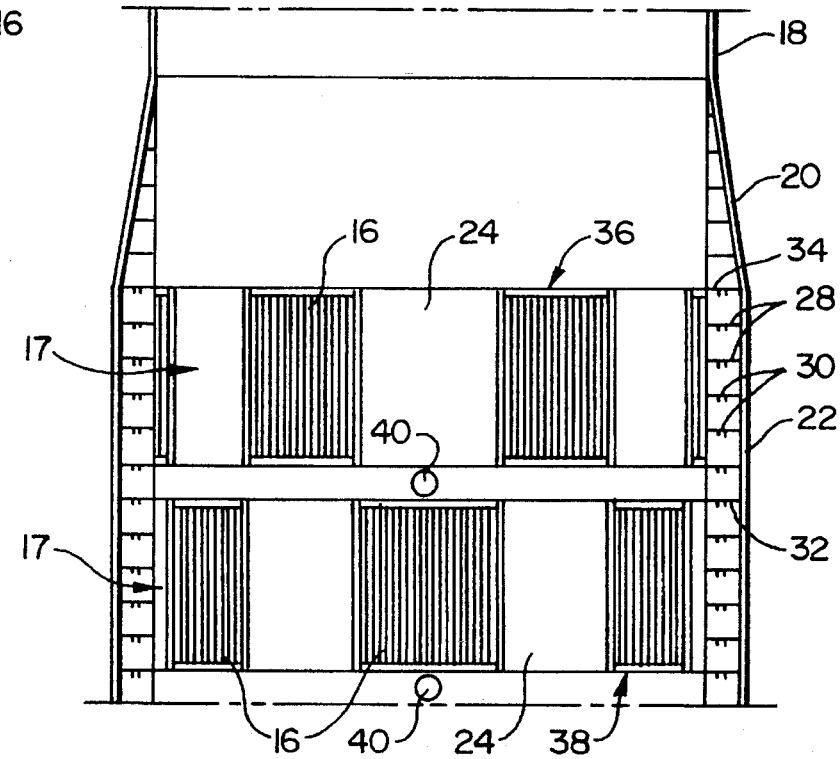
FIG. 3 PRIOR ART
FIG. 3 is a sectional view taken parallel to he vertical longitudinal axis of the digester, showing the locations of the screens in the digester.

The pulp and white liquor are fed into the upper end 12 of the digester, and the pulp is extracted at the bottom end 14 of the digester. It can be seen in this particular digester that there are several areas where liquid circulating screens 16 are positioned. With reference to FIGS. 2 and 3, it can be seen that the screens 16 are arranged in circumferential sets 17 at different vertical locations along the height of the digester. With reference to FIG. 3, it can be seen that the containing wall 18 of the digester tapers outwardly at 20 and then has a uniform diameter at a lower location 22. The screens 16 are positioned in two sets 17 within the sidewall section 22, and are spaced from one another in each set. Between each pair of adjacent screens there is an impervious curved wall section 24.

The surface of each screen 16 which faces inwardly toward the center axis of the digester 10 will be considered the "inside" surface, and the "outward" surface shall be considered the surface facing circumferentially outwardly toward the sidewall 18 of the digester.

Surrounding the two sets of screens, as shown in FIG. 3, there is a plurality of horizontally aligned circumferential ring plates 28 that support the screens 16 and the panels 24. These rings 28 are spaced vertically from one another, and each is provided with vertical through holes 30 to permit vertical flow between a lowermost ring 32 and an upper ring 34 for the upper set of screens 16. At a location below the upper set of rings 36 as seen in FIG. 3 and also below the lower set 38 there is mounted in the digester wall a respective pair of diametrically opposed outlet pipes 40 through which the liquid that is being extracted from the digester 10 flows. This liquid is either recirculated back into the system, delivered to an evaporator, or is otherwise processed in the system.

If the liquid that is removed is to be recycled back into the digester, then this is often done by moving the liquid to the top of the digester and feeding it downwardly through one of several concentric tubes to be discharged at the desired location within the digester.

As indicated previously herein, since the flow through the screens 16 is always in an outward direction, there is a tendency for the wood chips or pulp to become lodged in the openings of the screens or scaling deposits can form on the screens, thus impeding flow therethrough. When the clogging becomes sufficiently severe, then it is necessary to shut down the digester and clean the screens of such material, this being a very costly occurrence.

All of what is discussed above relative to FIGS. 1, 2 and 3 already exists in the prior art. The present invention will now be described with reference to FIGS. 4 through 11. One of the advantageous features of the present invention is that it can be adapted to be installed in the prior art digester as shown in FIGS. 1 through 3 as part of the original installation, and also can be retrofitted into an existing digester using the prior art system of FIGS. 1, 2 and 3.

The digester incorporating the first embodiment of the present invention is designated generally at 50, and comprises a containing structure 51 having a side wall 52 defining a substantially closed vertical tower, such as that shown in FIG. 1. The screens 16, panels 24 and circumferential rings 30 are not present. Instead, there is provided a plurality of screen/cleaning modules or units 54 which are arranged in circumferential sets 17, which are at vertically spaced locations within the digester 50. These screening/cleaning units 54 are arranged so that the digester can perform the same liquid extraction and recirculating functions which were discussed in the description of the prior art, with reference to FIGS. 1 through 3.

Each unit 54 comprises an enclosed sidewall frame 58, arranged in a square configuration. The sidewall 58 comprises two vertically extending side panels 60 and top and bottom panels 62. The side panels 60 have a rectangular configuration, while the top and bottom panels 62 have the rear edge thereof formed in a curve to fit against the interior curved surface 64 of the digester wall 52.

Figure 6:
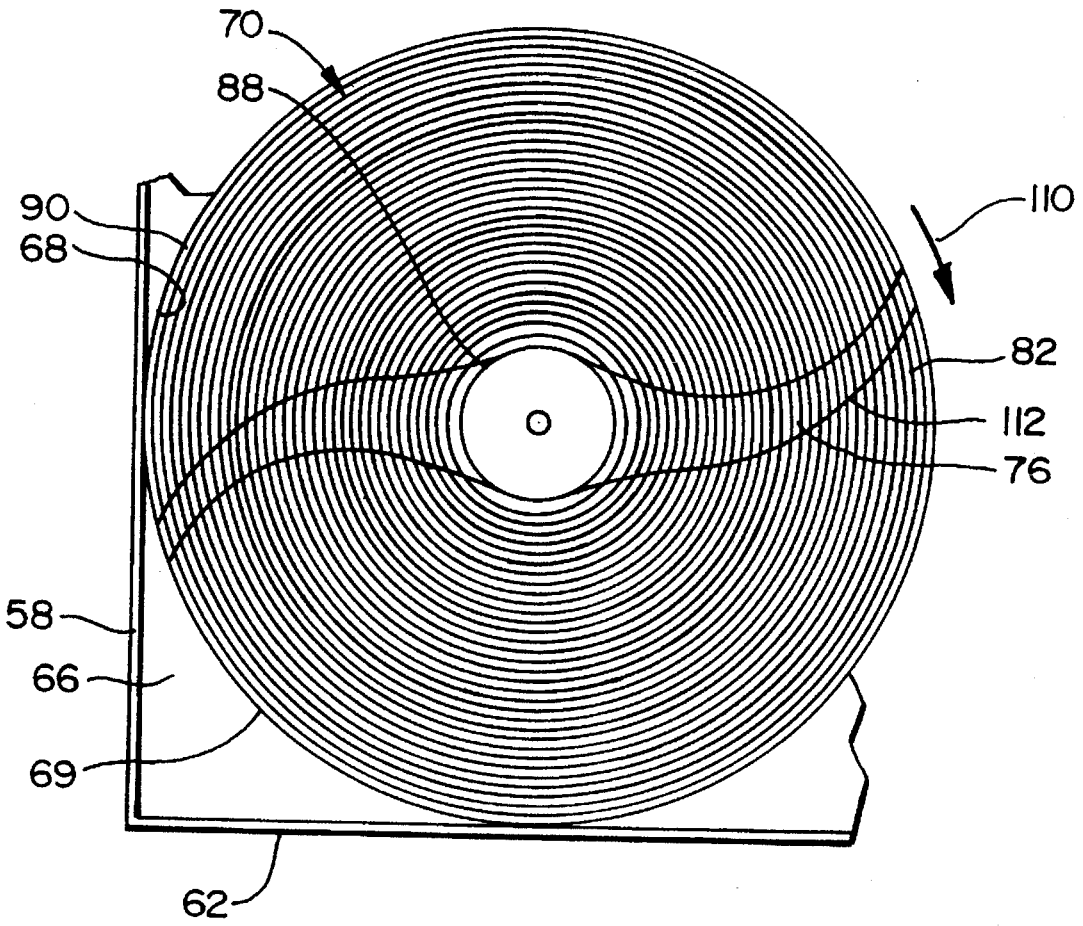
FIG. 6 is an elevational view showing only the inlet front surface of the screen/cleaning unit of FIGS. 4 and 5, and illustrating the cleaning blade in broken lines.

Each unit 54 has a planar wall 66 (only a portion of which is shown in FIG. 6) at the inside edge of the frame 58 and facing toward the center of the digester. This wall 66 has circular cut-out 68, having a diameter just slightly smaller than the width dimension of the sidewall frame 58. There is a circumferential ring 69 mounted in the cut out 68, and there is a circular screen unit 70 positioned in the ring 69. Also, the unit 54 comprises a cleaning blade unit 74 comprising a cleaning blade 76 and a hydraulic motor 78 to rotate the cleaning blade 76.

The circular screen unit 70 is made up of two components. First, there is a circular perforated support plate 80 extending across the entire area defined by the screen sidewall 72. This perforated plate is approximately 45% open area and about 10 mm thick. Connected to, and positioned inside of, the support plate 80 is a spiral shaped screen member 82 made from a continuous metal ribbon 86 which can be an extruded ribbon and which extends in a spiral from a center location 88 to a perimeter location 90. The lateral spacing of each spiral ribbon could be, for example, three millimeters. In cross section, each ribbon portion has a wider inwardly facing surface at 92 (e.g. one and one half millimeters across), and a somewhat narrower width at the outside surface 94 that is adjacent to the perforated support plate 80 (the width at 94 being, for example, one millimeter across). Thus, the slot 96 defined by adjacent spiral sections 92 is about one and one half millimeters at the entrance and about two millimeters at the exit. This spiral screen could be, for example, welded to the inside surface of the perforate support plate 80, or possibly positioned in slots in the support plate 80 and fixedly bonded or attached thereto.

The cleaning blade unit 76 is inside of the spiral screen member 82 and the support plate 80 which has a solid center portion 98. The hydraulic motor 78 can be mounted to the center portion 98 by a flange plate 100. The hydraulic motor 78 also has a rear plate 102 which can either bear against (or be adjacent to, or connected to) the inside sidewall surface 64 of the digester wall 52. The hydraulic motor 78 has a shaft 104 extending through the center of the place 98 and connecting to the center of the cleaning blade 76.

Figure 5:
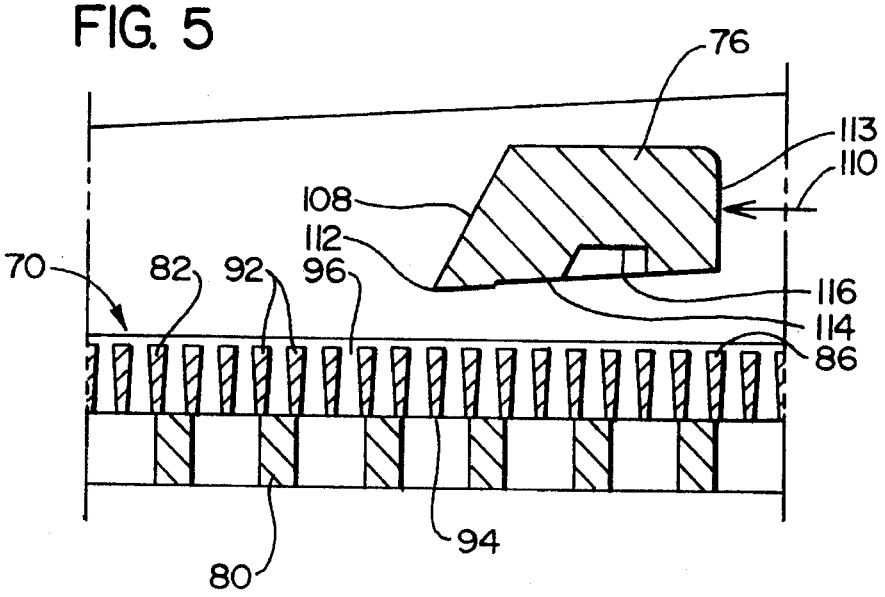
FIG. 5 is a sectional view similar to FIG. 4, but showing a portion of the screen and the cleaning blade, drawn to an enlarged scale, and with a cross section of the blade drawn to a further enlarged scale.

In FIG. 5, a portion of the screen unit 70 is shown drawn to an enlarged scale, and the cross section of the blade 76 is drawn to a further enlarged scale and (for purposes of illustration) spaced from the inside surface of the screen unit 70.

The cleaning blade 76, as shown in section in FIG. 5, is (or may be) of prior art design. As shown herein, the blade 76 has a slanted forward surface 108 which slants radially inwardly (i.e. to the center of the digester) and rearwardly (relative to the path of travel of the blade 76, indicated at 110). The blade 76 has an outwardly spaced leading edge 112, a rear surface 113, and a lower surface 114, having (in this particular configuration) a recess 116 extending along the radial length of the lower surface 114. The blade's leading edge 112 is curved convexly in plan view.

The lower surface 114 of the blade 76 is spaced a short distance away (e.g. 0.5 to 1.0 millimeter) from the inner surface 92 of the spiral screen member 82. The blade 76 (rotating in the direction 110) creates a low pressure area at its lower surface 114, and this draws wood chips or pulp fibers that may be positioned in the spiral screen member 82 in an inward direction so as to dislodge such wood chips or fibers.

The side panels 60 and ring member 69 of each screen/cleaning unit 54 each have a through opening 118 (see FIG. 4) so that each set of screen/cleaning units 54 positioned circumferentially around the inside of the digester 50 at the same elevation, communicate freely with one another. Then there is for each circumferential set 56 of screen/cleaning units 54 at least two (or more) exit pipes 120 (see FIG. 7) which extend through the digester wall 72 and which draw the liquid that has passed through the screen units 70 and into the chambers 122 defined by each frame enclosure 58 outwardly from the digester 50 either to be recycled or sent to some other location of the system for further processing.

There is for each hydraulic motor 78 in each screen/cleaning unit 54 a pair of couplings 126 (see FIG. 4) positioned in the sidewall 52 and connecting on the inside to related inside high pressure tubes 128 leading to the related hydraulic motor 78, and connecting on the outside to a pair of outside tubes 130 supplying the hydraulic fluid. The two hydraulic fluid lines 130 in turn are connected to a control valve 132 which controls the direction and amount of hydraulic fluid transmitted to the related motor 78 from a pump 134.

It is important to note that the entire screen/cleaning unit 54, including the screen unit 70, the blade 76 and the motor 78 are all positioned entirely within the sidewall 52 of the digester 50. The only outside connection for each such unit 54 are the two pipe couplings 126 which are positioned in relatively small openings drilled in the digester sidewall 52. It is a relatively simple matter to provide a seal between each coupling 126 and the sidewall 52 and also with the related hoses 122 and 124.

To describe the operation of the present invention, the digester 50 is operated in the usual manner, as described previously herein in the background of the invention. The blade 76 of each screen/cleaning unit 54 is rotated at a suitable rate of rotational speed to produce sufficient low pressure adjacent to the screen surface to draw the wood chips and other material that may be lodged in the screen unit 70. At the upper part of the digester where the wood chips are still uncooked, the rate of rotation of the propeller would be, for example, thirty to sixty revolutions per minute. At the lower part of the digester the rate would be, for example, one to ten revolutions per minute.

It is to be recognized that each of the screen/cleaning units 54 may be provided as a modular unit, preassembled at a factory location, and then brought to the site at which the digester 50 is being erected and installed. The installation can be accomplished simply by positioning the screen/cleaning units 54 in the appropriate position within the digester 50 and welding these or otherwise securing these in place. To make the connection outside the digester, it is necessary only to drill for each such unit 54 a pair of small holes, insert the couplings 126 therein and seal the same in the wall 52. Then the necessary connections can be made with the hydraulic hoses 128 and 130.

During operation, the rotational speed and direction of rotation of the blade 76 of each unit can easily be controlled through the volume and/or pressure of flow and direction of the hydraulic fluid.

The liquor exit pipes 120 can be made substantially the same as the prior art outlet pipes 40 of the prior art, as shown in FIG. 2.

Figure 4:
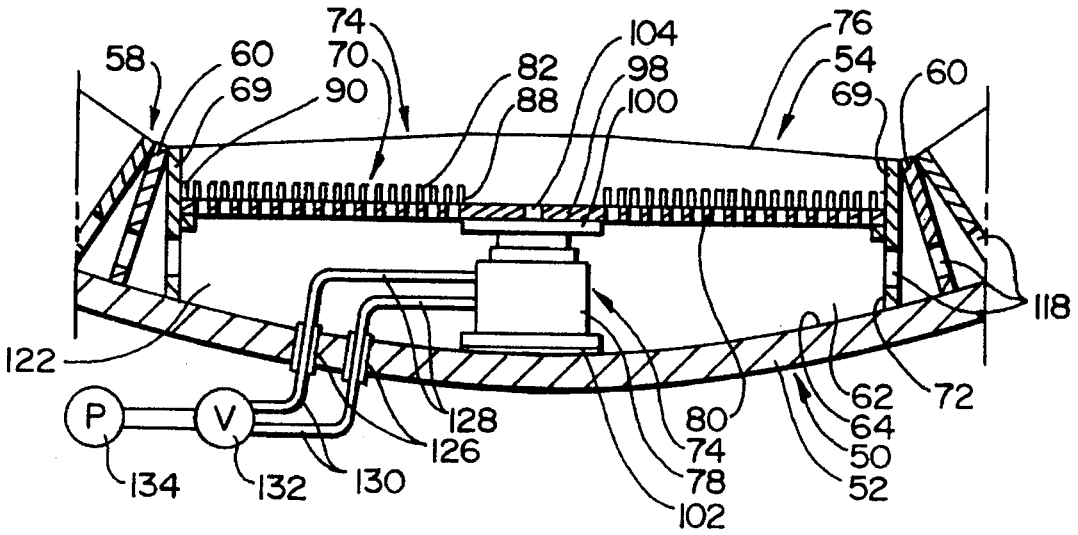
FIG. 4 is a horizontal sectional view, taken perpendicular to the vertical axis of the digester, showing a portion of the sidewall of the digester and one of the screen/cleaning units of the present invention.
Figure 7:
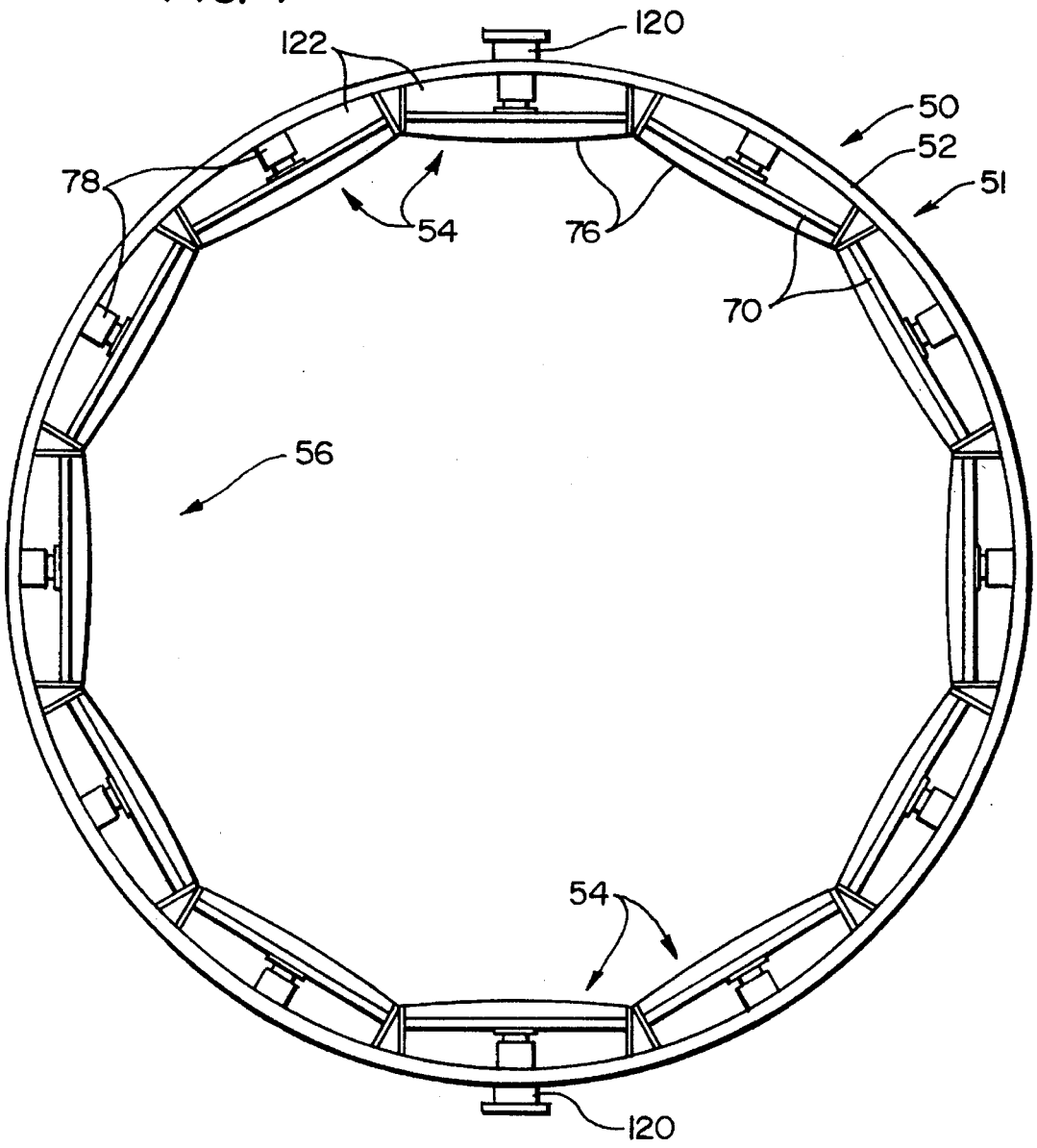
FIG. 7 is a horizontal sectional view taken across the digester showing a plurality of screening/cleaning units.

FIG. 7 is a cross sectional view showing a plurality of the units 54 distributed around the circumference of the sidewall 52 of the containing structure 51. The construction shown in FIG. 7 differs slightly from that shown in FIGS. 4 through 6 in that instead of having a single vertical sidewall 60 serving both adjacent units 54, there are two side panels 60 provided for each unit 54. Other than that, the construction is substantially the same as shown in FIGS. 4 through 6.

Figure 8:
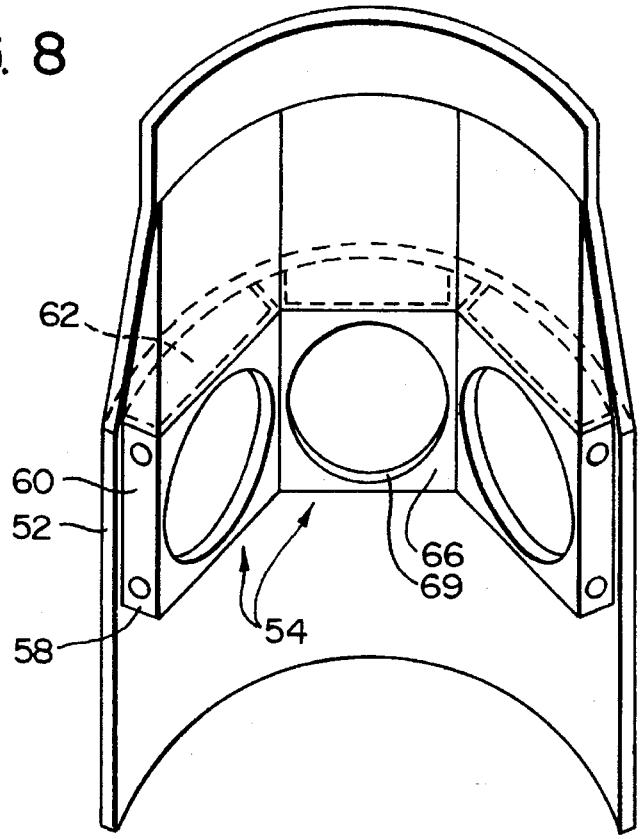
FIG. 8 is an isometric view showing several of the screening/cleaning units of the digester, but omitting certain components for clarity of illustration.

FIG. 8 is a perspective view showing only the peripheral wall portions of several units, the plate 66, and the circular wall 69, these being placed in the sidewall 52. For ease of illustration, the other components are not shown. Also, the curvature of the sidewall 52 relative to the units 54 is made somewhat tighter than what is shown in the other figures.

Figure 9:
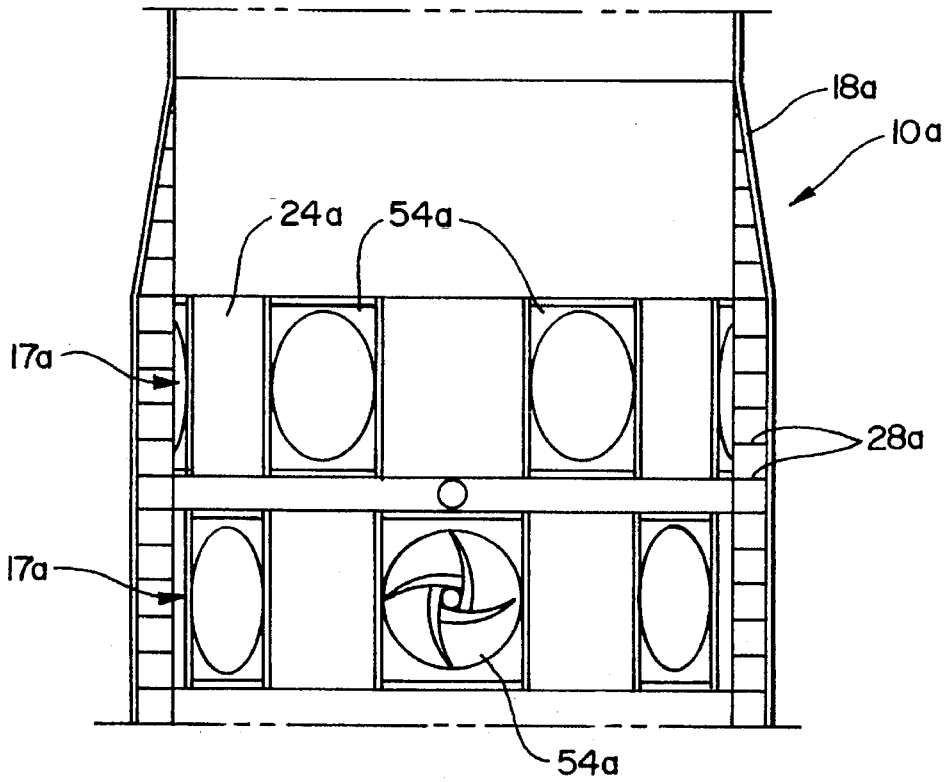
FIG. 9 is a longitudinal sectional view showing a second embodiment of the present invention where the cleaning units are retrofitted into an existing digester.

FIG. 9 shows somewhat schematically a second embodiment of the present invention where it is adapted to an existing digester, such as shown in FIGS. 1 through 3. Components which are similar (or the same as) components in the prior art digester shown in FIGS. 1 through 3 are similar to or the same as the components shown in the description of the first embodiment of FIGS. 3 through 8 will be given like numerical designations with an "a" suffix distinguishing those of the second embodiment shown in FIG. 9.

There is shown only a vertical sectional view, substantially the same as shown in FIG. 3, except that the screens 16 haven't been replaced with a plurality of units 54. It is believed that the manner in which this is accomplished is evident from the prior description, so this will not be disclosed in detail herein. Obviously, the ring plates 28*a* would have to be cut away or otherwise removed where these interfere at the locations of the screen/cleaning units 54*a*.

Figure 10:
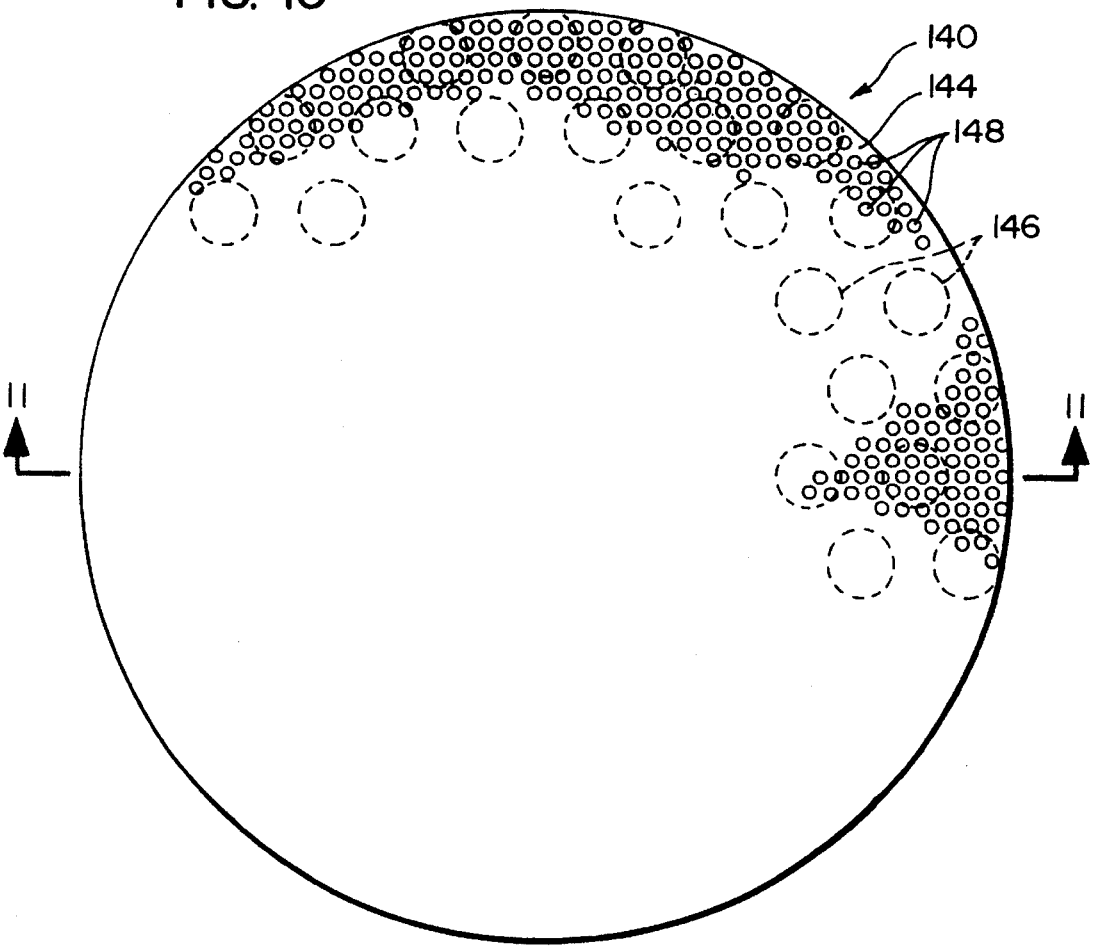
FIG. 10 is a plan view showing a modified form of the screen means.
Figure 11:
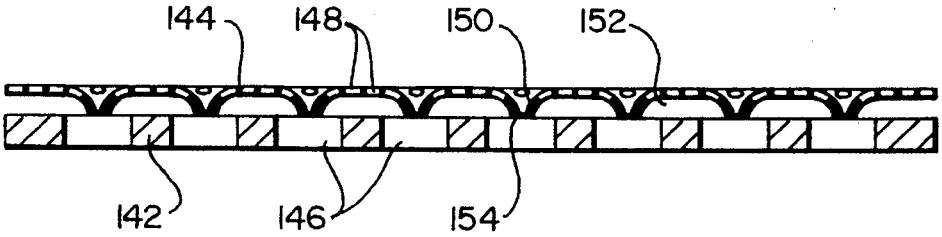
FIG. 11 is a sectional view taken along line 11—11 of FIG. 10.

FIG. 10 is a plan view of a modified construction of screen member. It is to be understood that this modified screen member 140 would be installed in substantially the same unit as shown in FIGS. 4 through 6 and that the hydraulic motor and propeller would be mounted to this modified screen member 140 in the same manner as shown FIGS. 4 through 6. However, for ease of illustration the other components have been not shown, and the center portion of this modified screen member would be provided with a mounting plate for the motor and the propeller.

This modified version of the screen member 140 comprises an outside base plate 142 and an inside plate 144.

The outside plate 142 is made of steel or some other metal and has a plurality of larger circular openings 146 evenly spaced over its surface. The diameter of these openings 146 could be, for example, one centimeter. This outside plate 142 is located adjacent to the liquid receiving region.

The inside plate 144 is made of a thinner sheet of steel or other metal material and has a plurality of smaller diameter openings 148, which could be, for example, approximately two millimeters in diameter. This inner plate 148 is spaced from the inside surface of the outer base plate 146. In the present embodiment, this is accomplished by forming outwardly extending dimples 150, this being accomplished by a suitable punch tool or other means. These dimples 150 project, for example, possibly three to five millimeters from the outside surface of the plate 144. This provides suitable spacing so that the liquid can flow through the openings 148 and then through the flow space 152 between the plates 144 and 148 and thence through the opening 146. Those outer portions 154 of the dimples that are in contact with the base plate 142 are secured to the base plate, for example, by a welding or the like.

It is believed that the operation of this screen member is evident from the above description, so this will not be described further herein.

It is to be recognized that various modifications and adaptations can be made to the present invention without departing from the basic teachings thereof.

What is claimed:

1. A pulp digester apparatus for delignifiying wood chips by employing a digesting liquid under pressure, said apparatus comprising:

a. a digester containing structure comprising a containing wall defining a digesting chamber to contain wood chips and digesting liquid under heat and pressure;

b. at least one liquid discharge screening/cleaning assembly positioned within said digesting chamber, said screening/cleaning assembly comprising:

i. a screen means having an intake surface facing said chamber and an outlet surface area facing into a liquid receiving region within said containing wall, said screen means being arranged to permit the liquid to pass therethrough into the receiving region while preventing the wood chips and fibers from passing therethrough ii. liquid outlet means positioned to remove the liquid from the liquid receiving region;

iii. a cleaning propeller positioned adjacent to the intake surface of the screen means and positioned and arranged so as to cause removal of material from said screen means;

iv. a power means located outside of said containing structure and having a power connection from said power means ascending from outside of said containing structure into said containing structure;

v. a motor operatively connected to said power connection, said motor having a drive output connected to said propeller to cause said cleaning propeller to remove said material collecting at the screen means, said motor and said drive connection being positioned entirely within said containing structure.

2. The apparatus as recited in claim 1, wherein said motor is a hydraulic motor, and said power means is a hydraulic pump, said power connection being hydraulic line means extending through said containing structure.

3. The apparatus as recited in claim 2, wherein said hydraulic line means extends through at least one opening in said containing wall and there is a seal means in said at least one opening to form a fluid tight connection between said hydraulic line means and said containing wall.

4. The apparatus as recited in claim 2, wherein said propeller is mounted for rotation about an axis of rotation, and the drive connection of the hydraulic motor comprises a shaft means connected to said propeller.

5. The apparatus as recited in claim 4, wherein said hydraulic motor is positioned in said liquid receiving region, and the shaft means extends through said screen means to connect to the propeller.

6. The apparatus as recited in claim 1 wherein said screen means comprises a support plate which is positioned adjacent to the liquid receiving region and has openings, and also comprising an inside screen member positioned adjacent to the digesting chamber, said inside screen member having opening means of a smaller dimension than the openings in said support plate.

7. The apparatus as recited in claim 6, wherein said inner screen member comprises an elongate strip means and said opening means are narrow elongate opening means.

8. The apparatus as recited in claim 7, wherein said elongate strip means comprises a strip arranged in a continuous spiral and said opening means are spiral opening means.

9. The apparatus as recited in claim 1 wherein said screen means comprises a base plate which is positioned adjacent to the liquid receiving region and has openings and also comprises an inside plate which has a plurality of openings, the openings of said inside plate being smaller than the openings of said base plate and which is spaced from said base plate so as to provide a flow area between said base plate and said inside plate.

10. The apparatus as recited in claim 9, wherein said inside plate has a plurality of outwardly extending dimples formed therein so as to engage said base plate and space the inner plate from the base plate.

11. The apparatus as recited in claim 1, where there is a plurality of said screening/cleaning assemblies positioned within said chamber.

12. A method of operating a pulp digester to delignify wood chips by employing a digesting liquid under pressure, said method comprising:

a. providing a digester containing structure comprising a containing wall defining a digesting chamber and having wood chips and digesting liquid in said chamber under heat and pressure;

b. providing at least one liquid discharge screening/cleaning assembly positioned within said digesting chamber, with said at least one assembly comprising:

i. a screen means having an intake surface facing said digesting chamber and an outlet surface area facing into a liquid receiving region within said containing wall;

ii. liquid outlet means positioned to remove the liquid from the liquid receiving region;

iii. a cleaning propeller positioned adjacent to the intake surface of the screen means and mounted to cause removal of material from said screen means;

iv. a power means located outside of said containing structure and having a power connection from said power means extending from outside of said containing structure into said containing structure;

v. a motor operatively connected to said power connection, said motor having a drive output connected to said propeller to cause said propeller to remove said material collecting at the screen means, said motor and said drive connection being positioned entirely within said containing structure;

c. withdrawing liquid from said liquid receiving region to a location outside of said containing structure so as to cause a flow of liquid from said digesting chamber through said screen means into said liquid receiving region, with wood chips and fibers being prevented from passing through said screen means;

d. operating said power means to supply power to said motor and to cause said motor to move said cleaning propeller along a cleaning path over said screen means, with said motor and said propeller operating entirely within said containing structure.

13. The method as recited in claim 12, wherein said motor is a hydraulic motor and said power means is a hydraulic pump, said method further comprising operating valve means to control flow of hydraulic fluid to said motor, with said hydraulic fluid flowing through hydraulic line means extending into said containing structure.

* * * * *